US009532623B2

(12) United States Patent
Kilgore et al.

(10) Patent No.: US 9,532,623 B2
(45) Date of Patent: Jan. 3, 2017

(54) SOLE STRUCTURE FOR AN ARTICLE OF FOOTWEAR WITH EXTENDED PLATE

(71) Applicant: NIKE, Inc., Beaverton, OR (US)

(72) Inventors: Bruce J. Kilgore, Lake Oswego, OR (US); Paul J. Francis, Beaverton, OR (US); Shane S. Kohatsu, Portland, OR (US); Andrea M. Vinet, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 15 days.

(21) Appl. No.: 14/612,971

(22) Filed: Feb. 3, 2015

(65) Prior Publication Data

US 2015/0223561 A1 Aug. 13, 2015

Related U.S. Application Data

(60) Provisional application No. 61/937,068, filed on Feb. 7, 2014.

(51) Int. Cl.

| | |
|---|---|
| ***A43B 13/14*** | (2006.01) |
| ***A43B 5/06*** | (2006.01) |
| ***A43B 13/12*** | (2006.01) |
| ***A43B 13/18*** | (2006.01) |

(52) U.S. Cl.

CPC ..... *A43B 13/14* (2013.01); *A43B 5/06* (2013.01); *A43B 13/122* (2013.01); *A43B 13/183* (2013.01)

(58) Field of Classification Search

CPC ..... A43B 5/06; A43B 5/12; A43B 5/14; A43B 5/01; A43B 13/00; A43B 13/02; A43B 13/023; A43B 13/026; A43B 13/0268

USPC ..... 36/25 R, 30 R, 24.5, 107, 104, 68, 31, 36/127–129, 103

See application file for complete search history.

(56) References Cited

U.S. PATENT DOCUMENTS

| | | | | | |
|---|---|---|---|---|---|
| 1,626,175 | A | * | 4/1927 | Zimmer | A63B 31/14 441/61 |
| 2,094,532 | A | * | 9/1937 | Glad | A63B 31/14 441/62 |
| 2,174,647 | A | * | 10/1939 | Wiessner | A43B 13/08 36/11.5 |
| 2,203,929 | A | * | 6/1940 | Shapiro | A43B 5/06 36/134 |
| 2,817,163 | A | * | 12/1957 | Clark | A43B 13/42 36/17 R |
| 3,019,458 | A | * | 2/1962 | De Barbieri | A63B 31/11 441/64 |
| 3,463,163 | A | * | 8/1969 | Matles | A43B 3/30 36/112 |

(Continued)

FOREIGN PATENT DOCUMENTS

FR 2457081 A1 12/1980

*Primary Examiner* — Shaun R Hurley
*Assistant Examiner* — Bao-Thieu L Nguyen
(74) *Attorney, Agent, or Firm* — Quinn Law Group, PLLC

(57) ABSTRACT

An article of footwear has a plate with an extension portion that enables traction and durability functions to be achieved while providing a greater surface area for forward propulsion. Specifically, a sole structure for an article of footwear has a plate with a heel portion, a midfoot portion, a forefoot portion, and an extension portion. The heel portion, the midfoot portion, and the forefoot portion correspond with a heel region, a midfoot region, and a forefoot region, respectively, of the article of footwear. The extension portion of the plate extends from the forefoot portion forward to a distal end.

20 Claims, 6 Drawing Sheets

(56) References Cited

U.S. PATENT DOCUMENTS 3,463,164 A * 8/1969 Matles ..... A43B 3/30 36/112
3,472,508 A * 10/1969 Baker ..... A63B 21/0004 36/83
3,672,077 A * 6/1972 Coles ..... A43B 13/26 12/142 P
3,810,269 A * 5/1974 Tabata ..... A63B 31/11 441/64
3,952,351 A * 4/1976 Gisbert ..... A63B 31/14 441/64
3,990,159 A * 11/1976 Borgeas ..... A43B 7/28 36/101
4,026,046 A * 5/1977 Clark ..... A43B 23/087 12/142 R
4,186,500 A * 2/1980 Salzman ..... A43B 5/0411 280/615
4,194,310 A * 3/1980 Bowerman ..... A43B 5/00 36/128
4,247,996 A * 2/1981 Grapin ..... A43B 5/18 36/103
4,300,255 A * 11/1981 Beuchat ..... A63B 31/11 441/64
4,312,141 A 1/1982 Mayer et al.
4,378,643 A * 4/1983 Johnson ..... A43B 13/223 36/129
4,404,759 A * 9/1983 Dassler ..... A43B 5/06 36/129
4,412,393 A * 11/1983 Terlizzi, Jr. ..... A43B 5/12 12/142 P
4,439,936 A * 4/1984 Clarke ..... A43B 5/06 36/102
4,453,996 A * 6/1984 Terlizzi, Jr. ..... A43B 5/12 156/227
4,514,916 A 5/1985 Aarflot
4,864,739 A * 9/1989 Maestri ..... A43B 7/142 12/146 M
4,934,073 A * 6/1990 Robinson ..... A43B 5/00 36/103
4,940,437 A * 7/1990 Piatt ..... A63B 31/11 441/61
5,075,984 A * 12/1991 Shiew ..... A43C 15/09 36/113
5,101,579 A * 4/1992 Terlizzi ..... A43B 5/12 36/113
5,151,060 A * 9/1992 Lam ..... A63B 31/11 441/62
5,163,859 A * 11/1992 Beltrani ..... A63B 31/11 441/61
5,259,798 A * 11/1993 Runckel ..... A63B 31/11 441/64
5,265,354 A * 11/1993 Aliano, Jr. ..... A43B 5/001 36/127
5,273,469 A * 12/1993 Lueschen ..... A63B 31/11 441/61
5,290,194 A * 3/1994 Sneddon ..... A63B 31/11 441/64
5,483,760 A * 1/1996 Kataoka ..... A43B 5/06 36/129
5,491,912 A * 2/1996 Snabb ..... A43B 5/00 36/113
5,649,373 A * 7/1997 Winter ..... A43B 5/12 36/28
5,706,589 A 1/1998 Marc
5,752,330 A * 5/1998 Snabb ..... A43B 5/00 36/114
5,775,010 A * 7/1998 Kaneko ..... A43C 15/02 36/129
5,829,172 A * 11/1998 Kaneko ..... A43B 5/06 36/108
6,032,388 A * 3/2000 Fram ..... A43B 13/26 264/273
6,053,788 A * 4/2000 Garofalo ..... A63B 31/11 441/64
6,061,931 A * 5/2000 Kaneko ..... A43B 1/0009 36/129
6,086,440 A * 7/2000 Fechtner ..... A63B 31/11 441/64
6,095,879 A * 8/2000 McCarthy ..... A63B 31/11 441/64
6,202,326 B1 * 3/2001 Hauglin ..... A43B 5/0415 36/117.2
6,219,940 B1 * 4/2001 Kita ..... A43B 13/026 36/103
6,393,735 B1 * 5/2002 Berggren ..... A43B 5/18 36/129
6,457,976 B1 * 10/2002 Fleshman ..... A43B 3/30 36/103
6,698,050 B1 * 3/2004 Frye ..... A43B 3/163 12/128 R
6,826,852 B2 * 12/2004 Fusco ..... A43B 13/12 36/103
6,843,693 B2 * 1/2005 McCarthy ..... A63B 31/11 441/64
6,884,134 B2 * 4/2005 McCarthy ..... A63B 31/11 441/64
7,100,309 B2 9/2006 Smith et al.
7,832,117 B2 11/2010 Auger et al.
8,356,428 B2 1/2013 Auger et al.
8,522,457 B2 * 9/2013 Scholz ..... A43B 13/141 36/102
8,567,097 B2 10/2013 Edy et al.
8,578,633 B2 * 11/2013 Roether ..... A43B 13/026 36/100
8,992,351 B2 * 3/2015 Manou ..... A63B 71/0009 36/127
2002/0112379 A1 * 8/2002 Sussmann ..... A43B 5/02 36/128
2004/0205983 A1 * 10/2004 Talbott ..... A43B 5/06 36/134
2005/0016029 A1 * 1/2005 Auger ..... A43B 1/0072 36/134
2009/0064538 A1 * 3/2009 Roether ..... A43B 13/026 36/88
2009/0172971 A1 * 7/2009 Peikert ..... A43B 13/026 36/88
2010/0186257 A1 * 7/2010 Karl ..... A43B 5/12 36/44
2010/0269368 A1 10/2010 Nakatsuka
2010/0293815 A1 * 11/2010 Ferrigan ..... A43B 3/0042 36/25 R
2012/0266500 A1 * 10/2012 Cobb ..... A43B 13/145 36/25 R
2012/0317843 A1 * 12/2012 Bove ..... A43B 13/14 36/25 R
2013/0139412 A1 6/2013 Auger et al.
2013/0210536 A1 * 8/2013 Winskowicz ..... A63B 69/3608 473/217
2015/0007455 A1 * 1/2015 Suffolk ..... A43B 5/12 36/88
2015/0164176 A1 * 6/2015 Shuman ..... A43B 13/14 36/136
2015/0181974 A1 * 7/2015 Davis ..... A43B 5/06 36/91
2015/0231449 A1 * 8/2015 Ortwig ..... A63B 31/11 441/61

* cited by examiner

SOLE STRUCTURE FOR AN ARTICLE OF FOOTWEAR WITH EXTENDED PLATE

CROSS-REFERENCE TO RELATED APPLICATIONS

This application claims the benefit of U.S. Provisional Application Ser. No. 61/937,068, filed on Feb. 7, 2014, which is hereby incorporated by reference in its entirety.

TECHNICAL FIELD

The present teachings generally include a sole structure and an article of footwear having the sole structure.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure for an article of athletic footwear to have a ground contact surface that provides sufficient traction and durability for a particular athletic endeavor.

DETAILED DESCRIPTION

Figure 1:
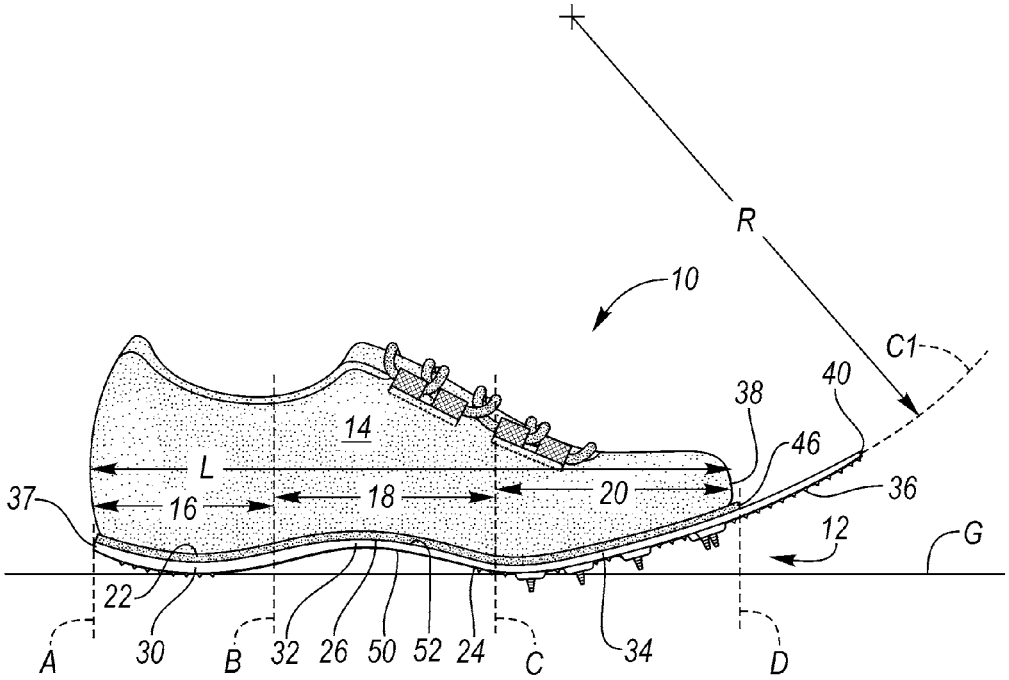
FIG. 1 is a schematic illustration in side view of an article of footwear with a sole structure that has a plate with an extension portion.
Figure 2:
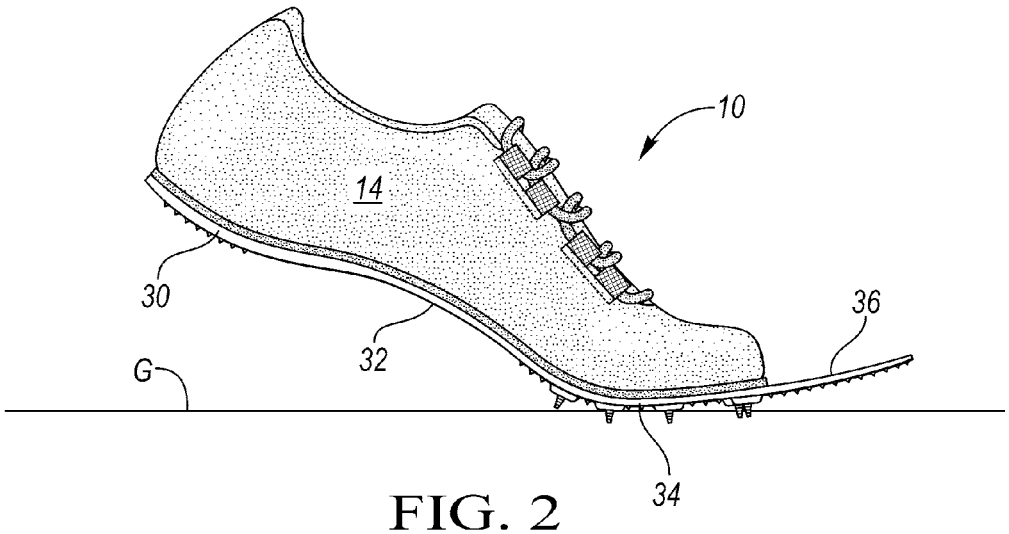
FIG. 2 is a schematic illustration in side view of the article of footwear of FIG. 1 at a first stage of motion.

An article of footwear has a plate with an extension portion that enables traction and durability functions of an outsole to be achieved while providing a greater surface area for forward propulsion. Specifically, a sole structure for an article of footwear has a plate with a heel portion, a midfoot portion, a forefoot portion, and an extension portion. The heel portion, the midfoot portion, and the forefoot portion correspond with a heel region, a midfoot region, and a forefoot region, respectively, of the article of footwear. The extension portion of the plate extends from the forefoot portion forward to a distal end.

In one embodiment, the extension portion of the plate extends forward of the forefoot portion by a first distance that is at least 5 percent of a length from a rear end of the heel portion to a front end of the forefoot portion. In another embodiment, the first distance is between 5 percent and 30 percent of the length from the rear end of the heel portion to the front end of the forefoot portion.

The extension portion of the plate may be configured to be stiffer than the forefoot portion. For example, in one embodiment, the heel portion has a first stiffness, the midfoot portion has a second stiffness, the forefoot portion has a third stiffness, and the extension portion has a fourth stiffness. The first stiffness is less than the second stiffness, the second stiffness is less than the third stiffness, and the third stiffness is less than the fourth stiffness. In some embodiments, the plate has a graduated stiffness that increases in magnitude from the heel portion forward to the extension portion.

The extension portion may have a stiffness sufficient such that the extension portion alone establishes a ground contract surface with a level ground plane, with the forefoot portion, the midfoot portion, and the heel portion separated from the level ground plane when the heel portion is sufficiently lifted from the level ground plane. The plate may have multiple layers of a composite material. The extension portion may have a greater number of the multiple layers than the heel portion. This may cause the extension portion to be stiffer than the heel portion of the plate.

In some embodiments, the plate has first side and a second side opposite the first side. A first traction element is secured to the first side. The plate has a first coefficient of friction, and the first traction element has a second coefficient of friction greater than the first coefficient of friction.

In some embodiments, the first traction element has a first set of substantially parallel elongated strips extending generally in a first direction. The first traction element has a second set of substantially parallel elongated strips extending in a second direction substantially perpendicular to the first direction. The first traction element may be secured to the first side of the plate at the extension portion, and an additional traction element may be secured to the first side of the plate at one of the forefoot portion and the heel portion. The additional fraction element may be discontinuous from the first traction element.

In some embodiments, the extension portion and the forefoot portion have a substantially equal radius of curvature. In other embodiments, a radius of curvature of the extension portion is less than a radius of curvature of the forefoot portion. In still other embodiments, the plate has a first side and a second side opposite the first side. A radius of curvature of the extension portion is on the first side, and a radius of curvature of the forefoot portion is on the second side.

In an embodiment, a sole structure for an article of footwear includes a plate that has a heel portion, a midfoot portion, a forefoot portion, and an extension portion. The heel portion, the midfoot portion, and the forefoot portion correspond with the heel region, the midfoot region, and the forefoot region of the article of footwear, respectively. The extension portion of the plate extends forward of the forefoot portion to a distal end by a first distance that is between 5 percent and 30 percent of a length from a rear end of the heel portion to a front end of the forefoot portion. The plate has a graduated stiffness that increases in magnitude from the heel portion forward to the extension portion.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like components throughout the several views, FIG. 1 shows an article of footwear 10 that has a sole structure 12. The article of footwear 10 may include a footwear upper 14 attached to the sole structure 12 and dimensioned according to a specific size chart for a human foot. As shown, the article of footwear 10 is an athletic shoe, such as for running track and field. In other embodiments, the article of footwear 10 could be a dress shoe, a work shoe, a sandal, a slipper, a boot, or any other category of footwear. The article of footwear 10 has a heel region 16, a midfoot region 18, and a forefoot region 20. The heel region 16 generally includes portions of the article of footwear 10 corresponding with rear portions of a human foot of the size of the article of footwear 10, including the calcaneus bone. The midfoot region 18 generally includes portions of the article of footwear 10 corresponding with an arch area of the human foot of the size of the article of footwear 10. The forefoot region 20 generally includes portions of the article of footwear 10 corresponding with the toes and the joints connecting the metatarsals with the phalanges of the human foot of the size of article of footwear 10.

The sole structure 12 may also be referred to as a sole assembly, as it may include multiple components. For example, the sole structure 12 may include a resilient sole component 22 attached to the footwear upper 14 and positioned under the footwear upper 14 when the sole structure 12 is resting on a level ground plane G. The sole component 22 may be a material that combines a desired level of resiliency and support, such as, in one example, an ethylene vinyl acetate (EVA) foam.

The sole structure 12 includes a plate 24 secured to a first side 26 of the sole component 22 that faces away from the upper 14. The plate 24 has a heel portion 30, a midfoot portion 32, a forefoot portion 34, and an extension portion 36. The heel portion 30, the midfoot portion 32, and the forefoot portion 34 correspond with the heel region 16, the midfoot region 18, and the forefoot region 20, respectively, of the article of footwear 10. The heel portion 30 of the plate 24 is defined as the rear third of the sole structure 12, and is shown in FIG. 1 as extending from a rear distal end 37 of the sole structure 12 at line A to line B. The midfoot portion 32 of the plate 24 is defined as the middle third of the sole structure 12, and is shown in FIG. 1 as extending from line B to line C. The forefoot portion 34 of the plate 24 is defined as the front third of the sole structure 12, and is shown in FIG. 1 as extending from line C to line D. For purpose of example only, lines B and C divide the article of footwear 10 lengthwise into equal thirds.

Figure 5:
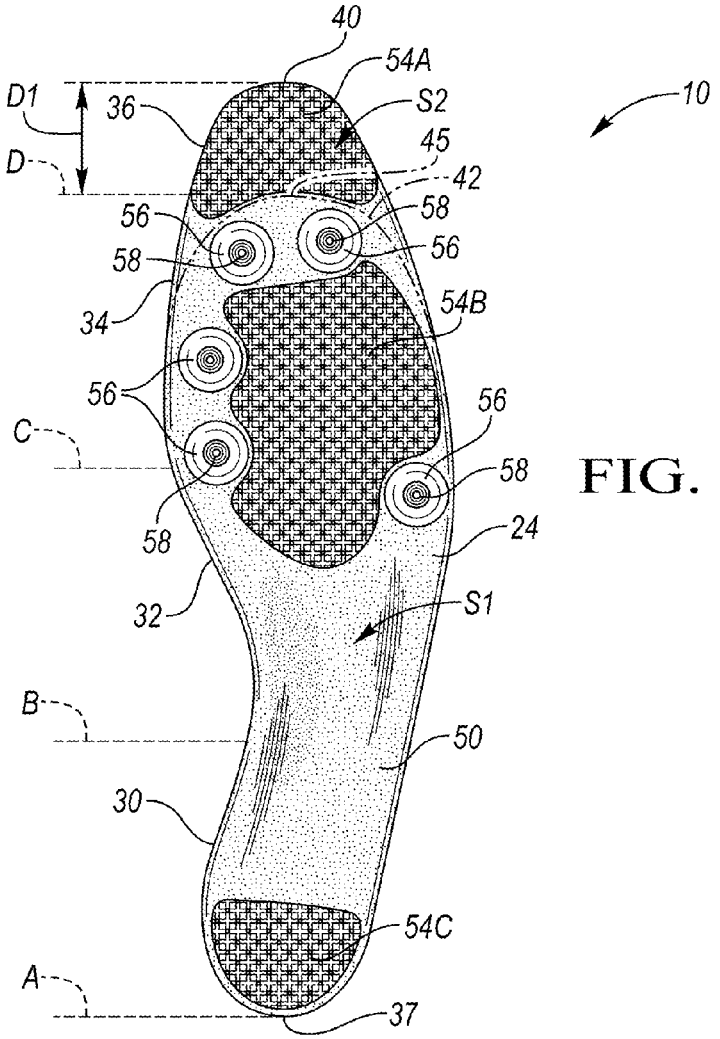
FIG. 5 is a schematic illustration in bottom view of the article of footwear of FIG. 1.

The extension portion 36 of the plate 24 extends from the forefoot portion 34 forward to a front distal end 40 of the article of footwear 10. The extension portion 36 extends further forward than both the sole component 22 and the foremost extent 38 of the upper 14. In the embodiment of FIG. 1, the curvature C1 of the extension portion 36 is the same as the curvature of the forefoot portion 34. In other words, the curvature C1 of the extension portion 36 follows the side profile of the forefoot portion 34, and the extension portion 36 and the forefoot portion 34 have a substantially equal radius of curvature R. As best shown in FIG. 5, the extension portion 36 increases the available surface area of the plate 24 that can be used as a ground contact surface during use of the article of footwear 10. More specifically, a conventional plate for the sole structure 12 would have a forward distal end 45 at a forward edge of the forefoot portion 34 indicated with a phantom line 42. The forward distal end 45 of the forefoot portion 34 and a forward distal end 46 of the sole component 22 are both at line D. The extension portion 36 extends forward of the forefoot portion 34 by a first distance D1 extending from the forward distal end 45 to the distal front end 40. The first distance D1 may be from 5 percent to 30 percent of the length L from the rear distal end 37 of the heel portion 30 to the forward distal end 45 of the forefoot portion 34. Thus, the conventional plate would have a surface area of surface S1, rearward of phantom line 42. The extension portion 36, however, adds the additional surface area of surface S2 that extends forward of the phantom line 42 to the distal front end 40 of the plate 24. The plate 24 thus extends from the rear distal end 37 of the sole structure 12 to the front distal end 40 and has a surface area that is the sum of the surface area of surface S1 and the surface area of surface S2. The rear distal end 37 of the sole structure 12 can also be referred to as the rear distal end of the plate 24.

Figure 3:
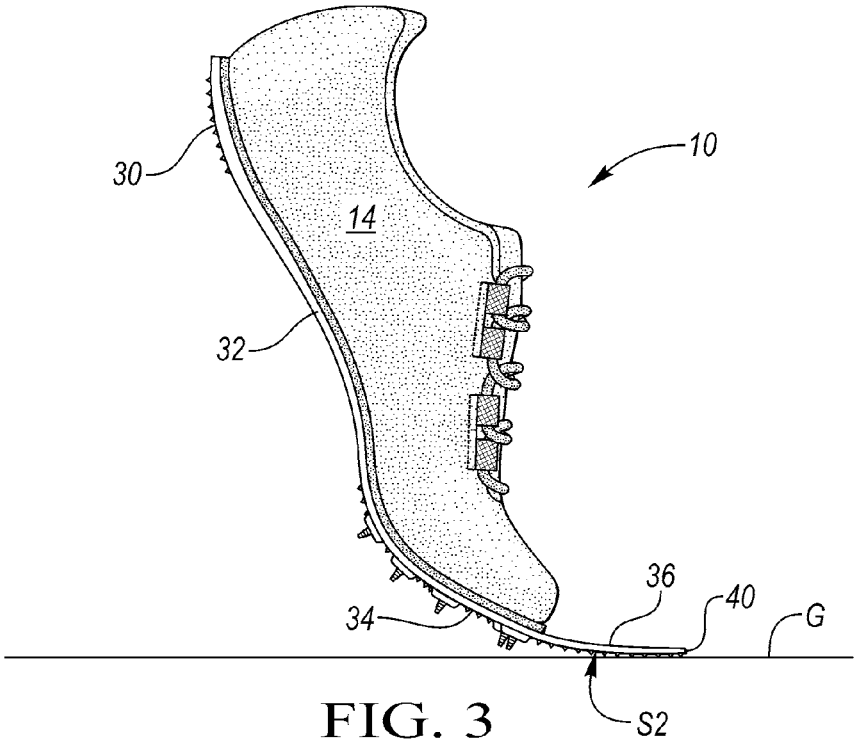
FIG. 3 is a schematic illustration in side view of the article of footwear of FIG. 1 at a second stage of motion.
Figure 4:
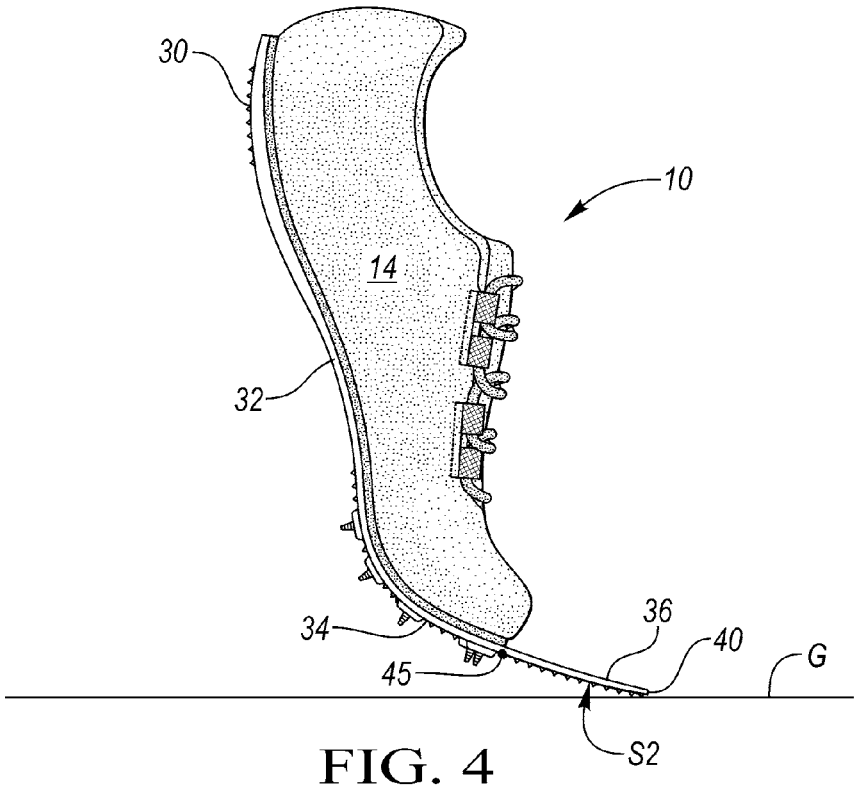
FIG. 4 is a schematic illustration in side view of the article of footwear of FIG. 1 at a third stage of motion.

When the article of footwear 10 is worn for certain activities, such as for track and field or other activities involving running, the article of footwear 10 progresses through the stages of motion in order from FIGS. 1-4. Alternatively, if the wearer's running motion is such that the heel portion 30 does not touch the level ground plane G for a period of time, i.e., remains above the ground surface, then the stages of motion may proceed from the stage of FIG. 2, through the stages of FIGS. 3 and 4, in order. In FIGS. 3 and 4, the stages of motion of the article of footwear 10 are such that the extension portion 36 alone establishes a ground contact surface with the level ground plane G. In fact, only a portion of the surface S2 serves as the ground contact surface during the stages of motion in FIGS. 3-4.

The plate 24 is specifically configured so that the extension portion 36 has a sufficient stiffness to enable the forefoot portion 34, the midfoot portion 32, and the heel portion 30 to be elevated above the level ground plane G while the extension portion 36 lifts from a rear extent of the extension portion 36 (i.e., from the phantom line 42 at the forward distal end 45 of the forefoot portion) to the front distal end 40 as the article of footwear 10 moves from the stage of motion of FIG. 3 to the stage of motion of FIG. 4. The stiffness of the extension portion 36 is sufficient to support a wearer of the article of footwear 10 in this manner when the article of footwear 10 is subjected to a predetermined range of forces correlated with an expected range of weights of the wearer of the article of footwear 10. The stiffness of the extension portion 36 allows the article of footwear 10 to effectively pivot forward during the fourth stage of motion in FIG. 4 about the front distal end 40 rather than pivoting about a forward distal end 45 of the forefoot portion 34, as would be the case with a conventional plate.

To achieve the requisite stiffness to enable the extension portion 36 to function as described while at the same time limiting added weight, the plate 24 may be formed of a composite material. Examples of composite materials include, but are not limited to fiber-reinforced composite materials (including short fiber-reinforced materials and continuous fiber-reinforced materials), fiber-reinforced polymers (including carbon-fiber reinforced plastic and glass-reinforced plastic), carbon nanotube reinforced polymers, as well as any other type of composite materials known in the art.

Figure 6:
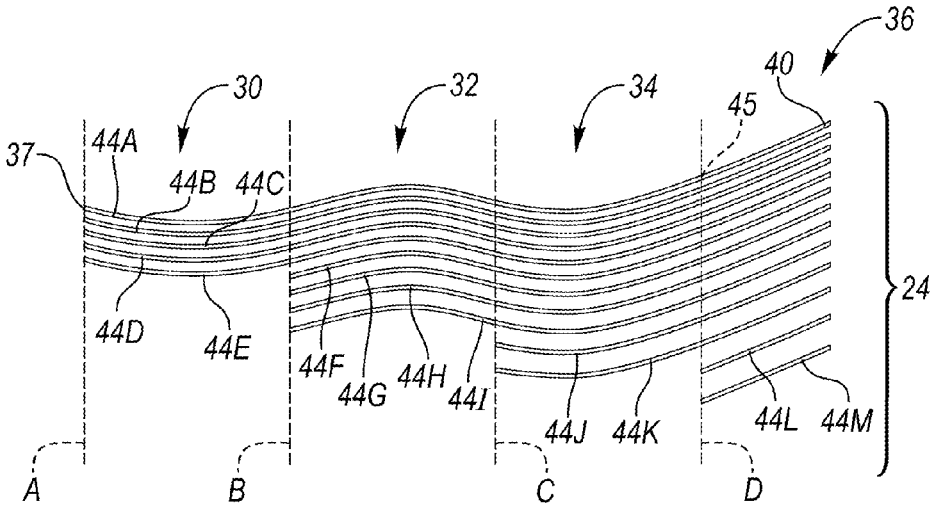
FIG. 6 is a schematic illustration in exploded side view of the plate of FIG. 1.

In one embodiment, shown in FIG. 6, the plate 24 is made of multiple layers of composite material, such as multiple layers 44A-44M of carbon-reinforced plastic. More specifically, the layers are of different lengths from the rear distal end 37 to the front distal end 40. Five of the layers 44A-44E extend the entire length of the plate 24. Four of the layers 44F-44I extend only in the midfoot portion 32, the forefoot portion 34, and the extension portion 36. Two of the layers 44J-44K extend only in the forefoot portion 34 and the extension portion 36. Two of the layers 44L-44M extend only in the extension portion 36. Accordingly, in the embodiment shown, the heel portion 30 has five layers, the midfoot portion 32 has nine layers, the forefoot portion 34 has eleven layers, and the extension portion 36 has thirteen layers. In one embodiment, the layers 44A-44M are each of substantially the same thickness and are of the same composite material. The heel portion 30 thus has a first stiffness, the midfoot portion 32 has a second stiffness, the forefoot portion 34 has a third stiffness, and the extension portion 36 has a fourth stiffness. The fourth stiffness is greater in magnitude than the third stiffness, which is greater in magnitude than the second stiffness, which is greater in magnitude than the first stiffness. Each stiffness has a related spring constant and/or other spring characteristic. Thus, the graduated stiffness of the plate 24 in the lengthwise direction, allows the extension portion 36 to have minimal flexing relative to the forefoot portion 34 as the article of footwear 10 rolls forward on the plate 24 from the heel portion 30 to the extension portion 36. The added length of the extension portion 36, and the associated added surface area of surface S2 forward of the forefoot portion 34 relative to a conventional plate effectively enables the plate 24 to provide a propulsion surface at the front of the article of footwear 10 equivalent to that of an article of footwear for a much larger size foot, such that the extension portion 36 acts as a lever.

Referring again to FIG. 5, the plate 24 has a bottom side 50 that generally faces the level ground plane G and is configured to serve as the ground contact surface. The bottom side 50 is shown in FIG. 1 opposite a top side 52 of the plate 24. The sole component 22 is attached to the top side 52 of the plate 24. The bottom side 50 is also referred to herein as a first side, and the top side 52 is also referred to herein as the second side. Several traction elements 54A, 54B, 54C are secured to the bottom side 50. A first traction element 54A is secured to the bottom side 50 at the extension portion 36. One or more additional traction elements may be secured to the plate 24 at other locations. For example, a second traction element 54B is secured to the bottom side 50 at the forefoot portion 34, and extends partially on the midfoot portion 32 of the plate 24. A third traction element 54C is secured to the bottom side 50 at the heel portion 30. The traction elements 54A-54C can be secured to the bottom side 50 by any suitable means such as by the use of adhesives or thermal bonding, depending on the material of the traction elements 54A-54C and of the plate 24.

The plate 24 is generally smooth on the bottom side 50, and has a relatively low first coefficient of friction. The traction elements 54A-54C are configured with a second coefficient of friction greater than the first coefficient of friction. For example, the plate 24 can be a composite material as discussed herein, and the traction elements 54A-54C can be rubber. Thus, the fraction elements 54A-54C provide increased grip of the sole structure 12 to the level ground plane G that prevents the sole structure 12 from slipping relative to the level ground plane G during the phases of motion in FIGS. 1-4. The traction elements 54A-54C also minimize lateral rotation of the sole structure 12 relative to the level ground plane G during wear. For example, when the article of footwear 10 is used during running around a curved track, each stride forward by the runner requires some lateral force to be imparted on the sole structure 12. By increasing traction, the traction elements 54A-54C prevent the lateral force from causing the sole structure 12 to turn clockwise or counterclockwise about a vertical axis through the plate 24 as the lateral force is reacted through one or more of the traction elements 54A-54C. FIG. 5 shows that the plate 24 has molded mounts 56 configured to retain spikes 58 that serve as additional traction elements. The traction elements 54A, 54B, 54C are shown as discontinuous from one another. In other embodiments, the traction elements 54A, 54B and/or 54C can be interconnected, or fewer or more similar traction elements can be secured to other areas of the bottom side 50.

In the embodiment of FIGS. 1-8, the plate 24 serves as an outsole of the article of footwear 10, as it at least partially establishes the ground contact surface S1, S2. In other embodiments within the scope of the present teachings, the plate 24 may be positioned elsewhere within the sole structure 12 or within other embodiments of sole structure while still providing the functions described herein with respect to plate 24. For example, an alternative plate could be positioned within a midsole, such as between layers of a midsole. Still further, an alternative plate could be positioned between an outsole and a midsole. In such embodiments, additional components of the sole structure, such as one or more midsole layers or an outsole, would extend with the plate 24 forward of the foremost extent 38 of the upper 14. Additionally, in any embodiment, an alternative plate could be multiple components and/or could extend rearward from the extension portion only to the forefoot portion (i.e., so the plate included only an extension portion and a forefoot portion), only to the midfoot portion (i.e., so the plate included only an extension portion, a forefoot portion, and a midfoot portion), or all of the way to the heel portion (i.e., so the plate included an extension portion, a forefoot portion, a midfoot portion, and a heel portion).

Figure 7:
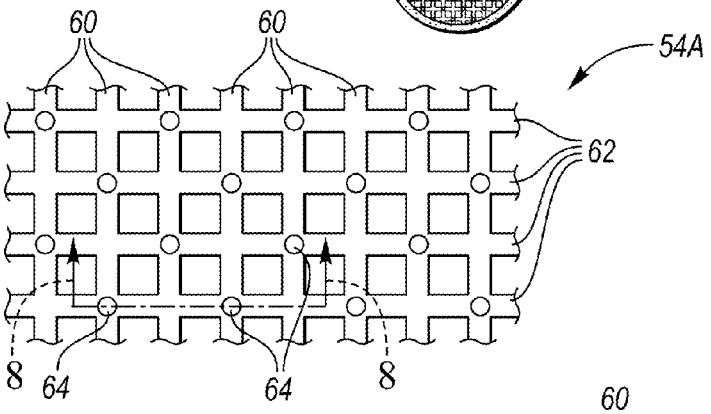
FIG. 7 is a schematic illustration in fragmentary plan view of a fraction element also shown secured to the plate of the article of footwear in FIG. 5.
Figure 8:
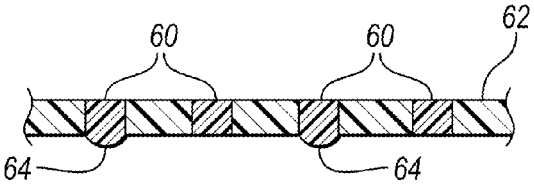
FIG. 8 is a schematic illustration in cross-sectional view of the traction element of FIG. 7 taken at lines 8-8 in FIG. 7.

The traction elements 54A-54C are shown with one example configuration referred to as a lattice pattern. As best shown in FIG. 7, the lattice pattern of a portion of traction element 54A has a first set of substantially parallel elongated strips 60 extending in a first direction, and a second set of substantially parallel elongated strips 62 extending in a second direction substantially perpendicular to the first direction. As used herein, the strips 60 are substantially parallel to one another if adjacent ones of the strips 60 extend lengthwise at less than a 5 percent angle from one another, and the strips 62 are substantially parallel to one another if adjacent ones of the strips 62 extend lengthwise at less than a 5 percent angle from one another. As used herein, the strips 60 are substantially perpendicular to the strips 62 if the strips 60 extend lengthwise at an angle to the strips 62 of between 85 to 95 degrees. The traction element 54A can be configured so that the strips 60, 62 are molded to one another, or the strips 60, 62 can be adhered to one another. FIGS. 7 and 8 show that the traction element 54A has nubs 64 that extend outward from the strips 60, 62. For example, the nubs 64 extend downward toward the level ground plane G in FIG. 1. The nubs 64 can be the same material as the strips 60, 62, or can be a different material, that may be a harder or softer material than the material of the strips 60, 62. The nubs 64 extend from alternating intersections of the strips 60, 62 in a repeating pattern in FIG. 7. The traction elements 54A-54C could be configured in other patterns or in other arrangements than that shown, and additional or fewer traction elements can be used.

Figure 9:
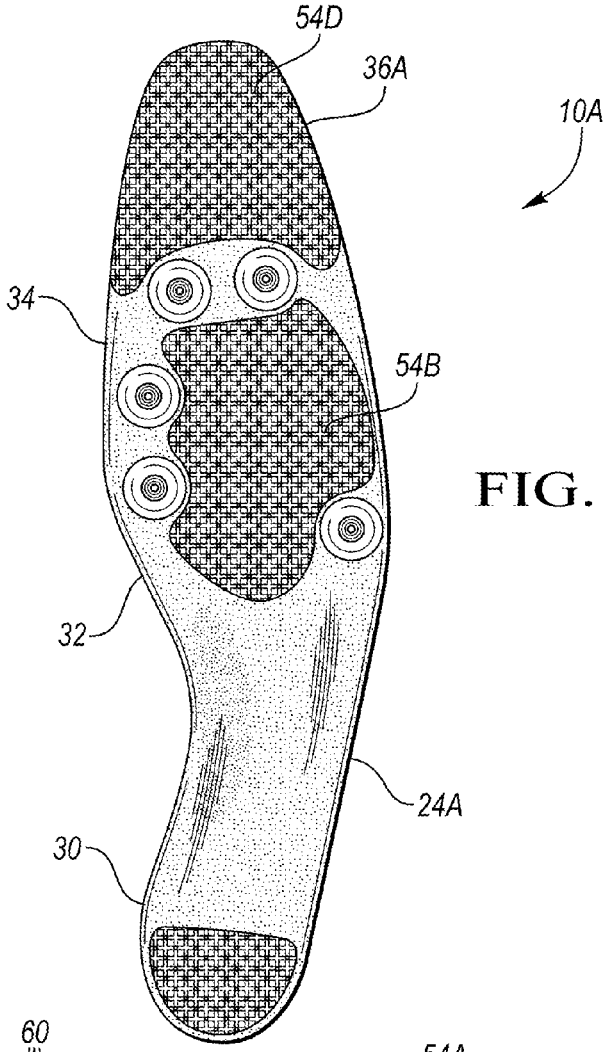
FIG. 9 is a schematic illustration in bottom view of an article of footwear having a plate with an alternative extension portion.
Figure 10:
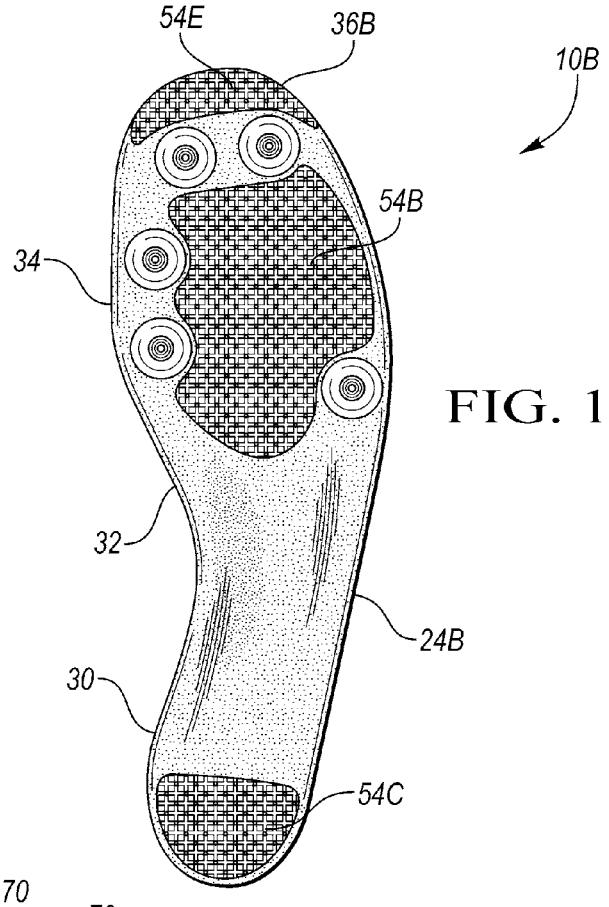
FIG. 10 is a schematic illustration in bottom view of an article of footwear having a plate with another alternative extension portion.

FIG. 9 shows an alternative article of footwear 10A alike in all aspects to the article of footwear 10 shown and described with respect to FIGS. 1-8, except having a plate 24A that has a longer extension portion 36A than the extension portion 36. A first traction element 54D is accordingly longer than first traction element 54A. The plate 24A is otherwise alike in all aspects to plate 24. FIG. 10 shows an alternative article of footwear 10B alike in all aspects to the article of footwear 10 shown and described with respect to FIGS. 1-8, except having a plate 24B that has a shorter extension portion 36B than the extension portion 36 and a first fraction element 54E accordingly longer than first traction element 54A. The plate 24B is otherwise alike in all aspects to plate 24. By way of non-limiting example, a comparison of the extension portions 36, 36A, 36B of FIGS. 1, 9, and 10 shows that the extension portion used can extend from 5 percent to 30 percent of the length L of the plate 24, 24A, or 24B, where the length L extends from the rear distal end 37 to the front distal end 45 of a conventional plate. The length L, indicated in FIG. 1, is also the distance from A to D.

Figure 11:
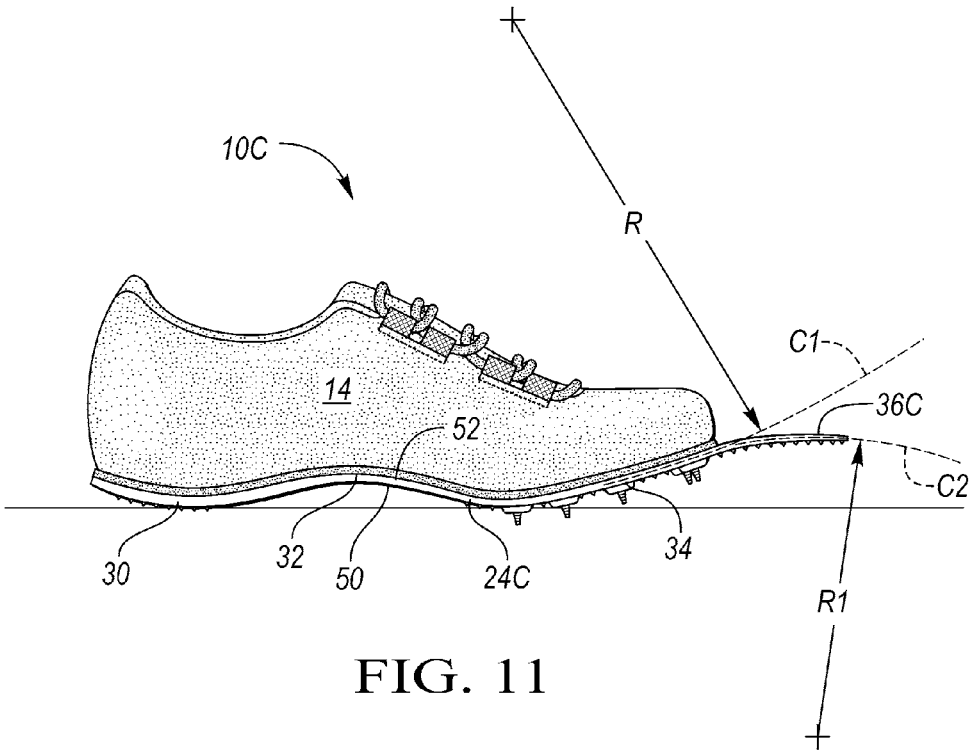
FIG. 11 is a schematic illustration in side view of an article of footwear having a plate with an alternative extension portion.

FIG. 11 shows another alternative embodiment of an article of footwear 10C that is alike in all aspects to the article of footwear 10 shown and described with respect to FIGS. 1-8, except having a plate 24C that has an extension portion 36C with a curvature C2 different than the curvature C1 of the forefoot portion 34. The plate 24D is otherwise alike in all aspects to plate 24. The curvature C1 following the profile of the forefoot portion 34 has a radius of curvature R that falls above the second side 52 of the plate 24C, while the curvature C2 of the extension portion 36C has a radius of curvature R1 that falls below the first side 50 of the plate 24C. Additionally, the radius of curvature R1 is smaller than the radius of curvature R.

Figure 12:
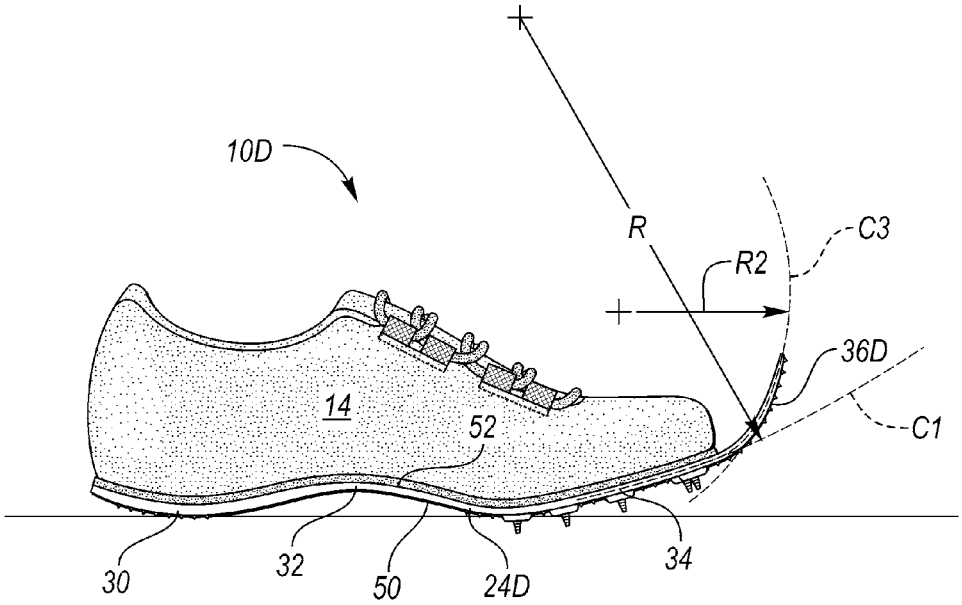
FIG. 12 is a schematic illustration in side view of an article of footwear having a plate with another alternative extension portion.

FIG. 12 shows another alternative embodiment of an article of footwear 10D that is alike in all aspects to the article of footwear 10 shown and described with respect to FIGS. 1-8, except having a plate 24D that has an extension portion 36D that has a curvature C3 different than the curvature C1 of the forefoot portion 34. The plate 24D is otherwise alike in all aspects to plate 24. The curvature C1 following the profile of the forefoot portion 34 has a radius of curvature R that falls above the second side 52 of the plate 24D. The curvature C3 of the extension portion 36D has a radius of curvature R2 that also falls above the second side 52 of the plate 24D, but the radius of curvature R2 is smaller than the radius of curvature R.

Figure 13:
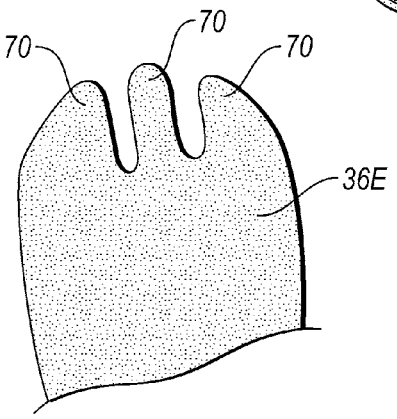
FIG. 13 is a schematic illustration in fragmentary plan view of another alternative extension portion for the plate of FIG. 1.
Figure 14:
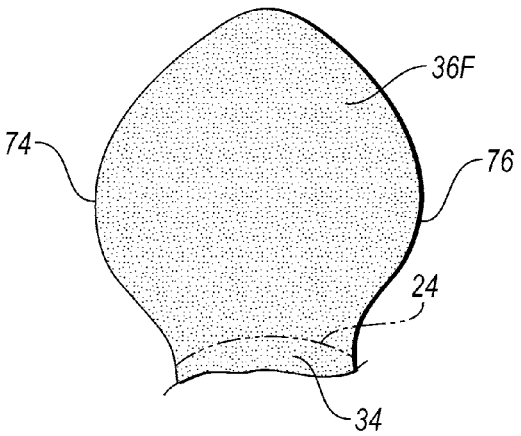
FIG. 14 is a schematic illustration in fragmentary plan view of another alternative extension portion for the plate of FIG. 1.

FIG. 13 shows a fragmentary plan view of a bottom side of a different extension portion 36E that can be used with the plate 24 as an alternative to the extension portion 36. The extension portion 36E has a plurality of fingers 70 having different shapes. FIG. 14 shows a fragmentary plan view of a bottom side of another different extension portion 36F that can be used with the plate 24 as an alternative to the extension portion 36. The extension portion 36F flares outward laterally relative to the forefoot portion 34. Specifically, the extension portion 36F flares outward both on a lateral side 74 and on a medial side 76. The flared extension portion 36F provides enhanced lateral stability. As used herein, a lateral side of a component for an article of footwear, such as lateral side 74 of the extension portion 36E, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear 10, such as medial side 76 of the extension portion 36E, is the side that corresponds with an inside area of the foot of the wearer and is generally closer to the other foot of the wearer (i.e., the side closer to the hallux of the foot of the wearer). The hallux is commonly referred to as the big toe.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

What is claimed is:

1. A sole structure for an article of footwear having an upper, wherein the upper has a heel region, a midfoot region, and a forefoot region, the sole structure comprising:

a plate having a heel portion, a midfoot portion, a forefoot portion, and an extension portion; wherein:

the plate has a top side and a bottom side opposite the top side;

the top side is nearer to the upper than the bottom side;

the heel portion, the midfoot portion, and the forefoot portion correspond with the heel region, the midfoot region, and the forefoot region of the upper, respectively;

the extension portion extends forward from a forward edge of the forefoot portion forward to a distal end and is entirely forward of the upper; and the top side of the plate is spaced apart from the upper between the forward edge of the forefoot portion and the distal end;

wherein the extension portion has a stiffness configured such that the extension portion alone establishes a ground contact surface with a level ground plane, with the forefoot portion, the midfoot portion, and the heel portion separated from the level ground plane when the heel portion is sufficiently lifted from the level ground plane during a forward stride.

2. The sole structure of claim 1, wherein:

the extension portion of the plate extends forward of the forefoot portion by a first distance; and the first distance is at least 5 percent of a length from a rear end of the heel portion to a front end of the forefoot portion.

3. The sole structure of claim 1, wherein:

the extension portion of the plate extends forward of the forefoot portion by a first distance; and the first distance is between 5 percent and 30 percent of a length from a rear end of the heel portion to a front end of the forefoot portion.

4. The sole structure of claim 1, wherein the extension portion of the plate is configured to be stiffer than the forefoot portion.

5. The sole structure of claim 4, wherein:

the heel portion has a first stiffness, the midfoot portion has a second stiffness, the forefoot portion has a third stiffness, and the extension portion has a fourth stiffness; and the first stiffness is less than the second stiffness, the second stiffness is less that the third stiffness, and the third stiffness is less than the fourth stiffness.

6. The sole structure of claim 1, wherein the plate has a graduated stiffness that increases in magnitude from the heel portion forward to the extension portion.

7. The sole structure of claim 1, wherein:

the plate has multiple layers each of one composite material; and the extension portion has a greater number of said multiple layers than the heel portion.

8. The sole structure of claim 1, further comprising:

a first traction element secured to the first side; wherein:

the plate has a first coefficient of friction; and the first traction element has a second coefficient of friction greater than the first coefficient of friction.

9. The sole structure of claim 8, wherein:

the first traction element has a first set of substantially parallel elongated strips extending generally in a first direction; and the first traction element has a second set of substantially parallel elongated strips extending in a second direction substantially perpendicular to the first direction.

10. The sole structure of claim 9, wherein the first traction element is secured to the first side of the plate at the extension portion, and further comprising:

an additional traction element secured to the first side of the plate at one of the forefoot portion and the heel portion; and wherein the additional traction element is discontinuous from the first traction element.

11. The sole structure of claim 1, wherein the extension portion and the forefoot portion have a substantially equal radius of curvature.

12. The sole structure of claim 1, wherein a radius of curvature of the extension portion is less than a radius of curvature of the forefoot portion.

13. The sole structure of claim 1, wherein:

a radius of curvature of the extension portion is on the first side, and a radius of curvature of the forefoot portion is on the second side.

14. A sole structure for an article of footwear, wherein the article of footwear has a heel region, a midfoot region, and a forefoot region, the sole structure comprising:

a plate having a heel portion, a midfoot portion, a forefoot portion, and an extension portion; wherein:

the heel portion, the midfoot portion, and the forefoot portion correspond with the heel region, the midfoot region, and the forefoot region, respectively;

the extension portion extends from the forefoot portion forward to a distal end by a first distance;

the first distance is between 5 percent and 30 percent of a length from a rear end of the heel portion to a front end of the forefoot portion;

the plate has multiple layers of a composite material;

each of the multiple layers extends in the extension portion to the front distal end;

a first set of said multiple layers extends in the heel portion, the midfoot portion, the forefoot portion and the extension portion;

a second set of said multiple layers extends under the first set and only in the midfoot portion, the forefoot portion and the extension portion;

a third set of said multiple layers extends under the second set and only in the forefoot portion and the extension portion;

a fourth set of said multiple layers extends under the third set and only in the extension portion; and the plate has a graduated stiffness that increases in magnitude from the heel portion forward to the extension portion.

15. The sole structure of claim 14, wherein:

the heel portion has a first number of said multiple layers;

the midfoot portion has a second number of said multiple layers;

the forefoot portion has a third number of said multiple layers;

the extension portion has a fourth number of said multiple layers; and the first number is less than the second number, the second number is less than the third number, and the third number is less than the fourth number.

16. The sole structure of claim 14, wherein the extension portion has a stiffness sufficient such that the extension portion alone establishes a ground contact surface with a level ground plane, with the forefoot portion, the midfoot portion, and the heel portion separated from the level ground plane when the heel portion is sufficiently lifted from the level ground plane.

17. The sole structure of claim 14, wherein the plate has a first side and a second side opposite the first side; and further comprising:

a first traction element secured to the first side; wherein:

the plate has a first coefficient of friction; and the first traction element has a second coefficient of friction greater than the first coefficient of friction.

18. The sole structure of claim 14, wherein a radius of curvature of the extension portion is less than or equal to a radius of curvature of the forefoot portion.

19. The sole structure of claim 14, wherein:

the plate has a first side and a second side opposite the first side;

a radius of curvature of the extension portion is on the first side; and a radius of curvature of the forefoot portion is on the second side.

20. The sole structure of claim 1, wherein the plate is an outsole.

* * * * *